US005193713A

United States Patent [19]

Greathouse et al.

[11] Patent Number: 5,193,713

[45] Date of Patent: Mar. 16, 1993

[54] TRASH CAN CONVERSION KIT

[76] Inventors: Dan L. Greathouse, 1804 Camina Pl.; Thomas C. Street, 3104 Northridge, both of Farmington, N. Mex. 87401

[21] Appl. No.: 570,603

[22] Filed: Aug. 21, 1990

[51] Int. Cl.[5] ..... B65F 1/06; B65D 90/04

[52] U.S. Cl. ..... 220/528; 220/404; 220/909; 248/101

[58] Field of Search ..... 220/909, 404, 528; 248/99, 101, 907

[56] References Cited

U.S. PATENT DOCUMENTS

| | | | |
|---|---|---|---|
| 754,580 | 3/1904 | Madden et al. | 248/101 |
| 1,953,042 | 3/1934 | Cody | 248/101 |
| 3,217,892 | 11/1965 | Goodell | 248/907 |
| 4,287,701 | 9/1981 | Washington | 248/99 |
| 4,338,979 | 7/1982 | Dow | 220/404 |
| 4,585,283 | 4/1986 | Redmon et al. | 220/404 |
| 4,750,638 | 6/1988 | Sosower | 220/909 |
| 4,759,467 | 7/1988 | Byrne | 220/528 |
| 4,834,262 | 5/1989 | Reed | 220/909 |
| 4,905,853 | 3/1990 | Strawder | 220/909 |
| 4,948,075 | 8/1990 | Allen | 248/907 |

*Primary Examiner*—Stephen Marcus
*Assistant Examiner*—S. Castellano

[57] ABSTRACT

Expandable, elastic material is connected in a circle with two or more straps of the same material attached in such a manner as to create several sectors to hold any type of disposable or non-disposable trash bags. The design is such that it could fit most existing trash containers. A hard plastic center holding cap would secure the bags.

1 Claim, 4 Drawing Sheets

TRASH CAN CONVERSION KIT

BACKGROUND OF THE INVENTION

1. Field of the Invention

The present invention relates to a separating device for recycling domestic and commercial refuse. More specifically, the present invention relates to an expandable elastic band device used to convert ordinary trash cans into containers which can hold two or more biodegradable trash bags.

2. Prior Art

Recycling refuse has become one of the best solutions to cleaning the environment. At present, separation of refuse into various types for recycling is time consuming, inconvenient, dirty work. If recycling is not done by the initial separation of refuse, it is doubtful that it will be done at all. The trash can conversion kit performs this function.

Using several trash containers or units with built-in separate bins are currently utilized in many areas.

No device is known, however, for converting ordinary trash cans into containers which will hold two or more biodegradable trash bags.

SUMMARY OF THE INVENTION

The principal object of the present invention is to provide a device for use in separating domestic and commercial refuse in an effective and convenient manner.

It is also an object of the present invention to provide such a device which is of simple, inexpensive construction.

Another object is to provide such a device in a form that can be assembled and disassembled quickly and easily for use on most existing trash containers.

A further object is to provide such a device which, in use, will encourage the immediate separation of refuse and eventual recycling of such refuse.

The foregoing objects can be accomplished by providing an expandable elastic band device which can be placed at the top of a trash container. The device consists of an expandable elastic band, circular in shape. One or more diametrical elastic bands divide the interior into as many sectors as desired. Once this device is in place on the conventional trash container, two or more biodegradable trash bags can be placed in the sectors which are created. A center holding cap secures the trash bags at the center of the existing container.

DETAILED DESCRIPTION

Figure 1:
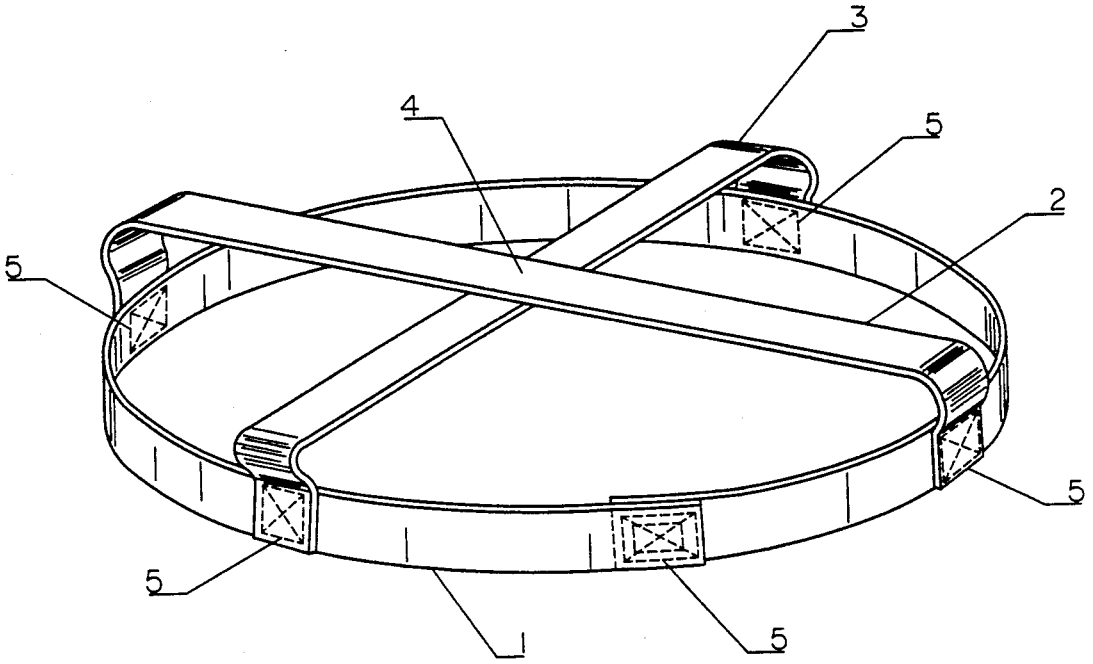
FIG. 1 is a top perspective of an expandable elastic band with two intersecting diametrical bands dividing the interior into four sectors.

As shown in the drawings, the preferred trash can conversion kit consists of one circular expandable elastic band to be fitted on the outside perimeter of the existing trash container. Two intersecting elastic bands divide the interior of the circle into four sectors. There is a center cap.

As shown in FIG. 1, expandable elastic strap 1 is formed in the shape of a circle. Straps, of the same material, labelled 2 and 3 are attached to 1. They are sewn or attached to circle 1 at points labelled 5. Straps 2 and 3 are not attached to each other at intersection 4.

Figure 2:
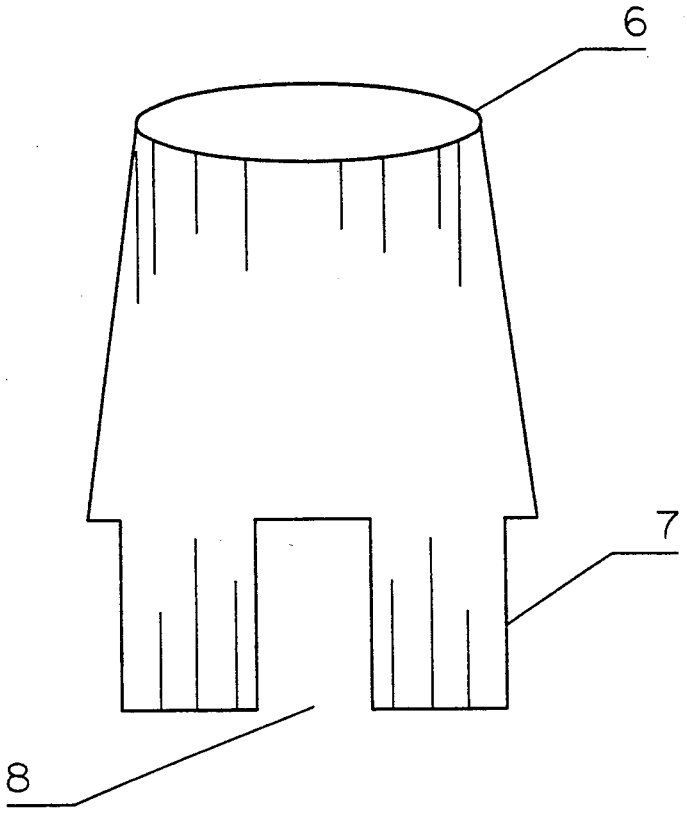
FIG. 2 is a side perspective of the center holding cap.

As shown in FIG. 2, there is a hard plastic cap labelled 6 with four legs labelled 7 creating four spaces labelled 8.

Figure 3:
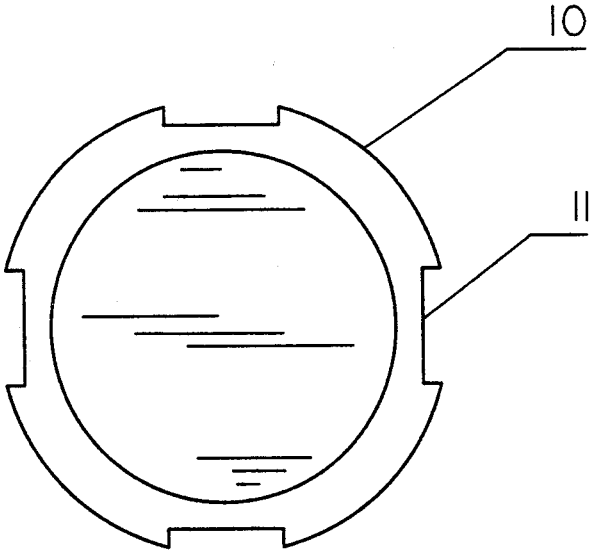
FIG. 3 is a bottom perspective of the center holding cap.

As shown in FIG. 3, the plastic legs labelled 10 alternate with the spaces labelled 11.

Figure 4:
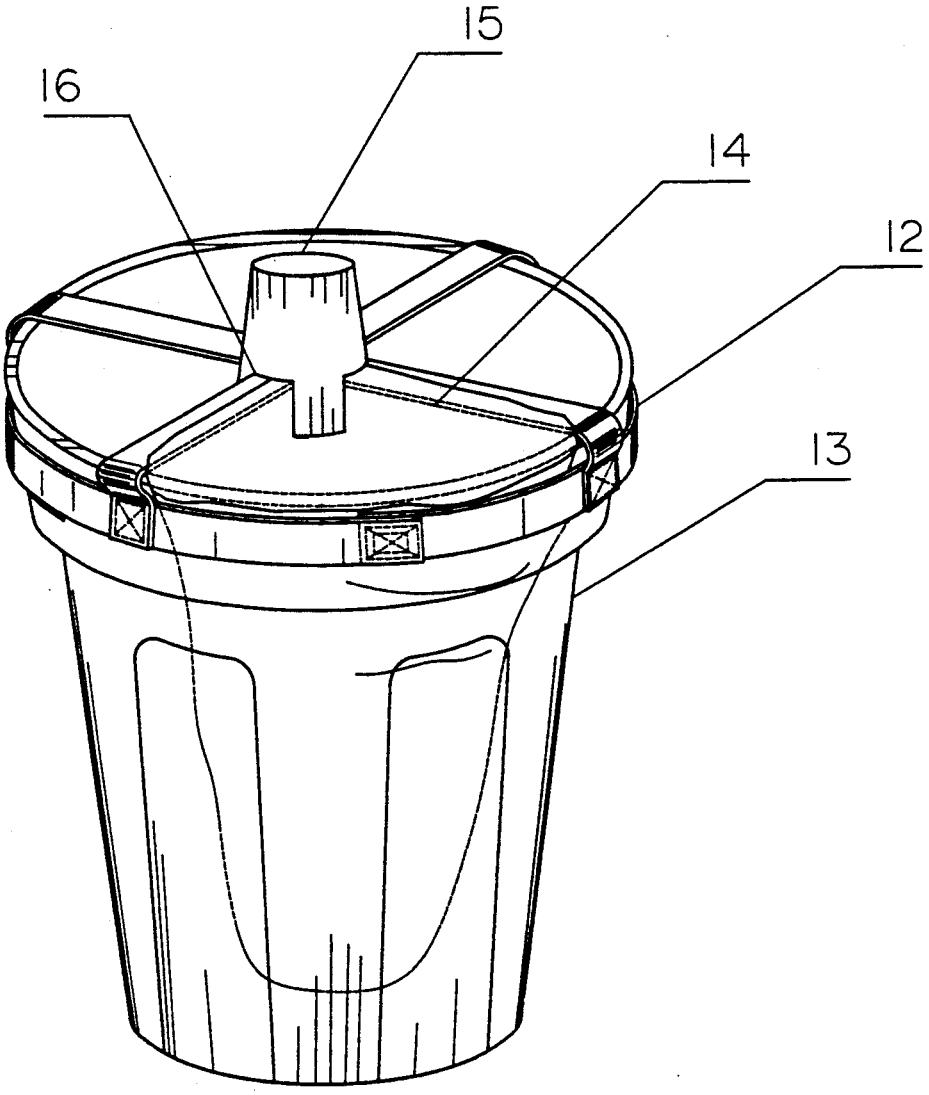
FIG. 4 is an assembled perspective view of the device.
Figure 5:
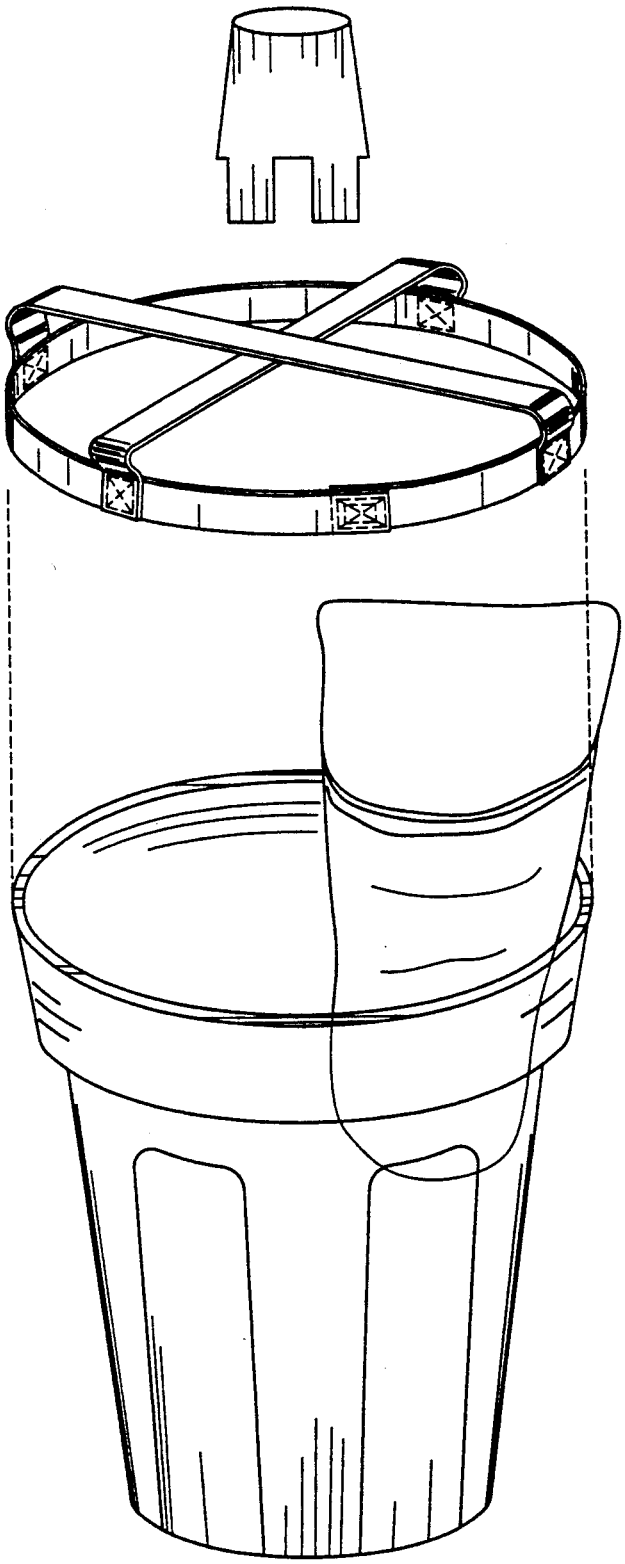
FIG. 5 is an exploded perspective view of the device, its cap, the trash container, and the biodegradable trash bags.

As shown in FIG. 4, the device labelled 12, fits onto the existing trash container labelled 13. Then the trash bags (biodegradable) 14 fit into the four created spaces. Then the plastic center holding cap labelled 15 is placed at the intersection labelled 16.

The expandable elastic construction of the device will allow for quick assembly and disassembly and for the use on various shapes and sizes of trash containers. The elastic band could be ⅛ inch in thickness and could be 2 inches wide. The outside diameter could be 24 inches expandable to 52 inches. The central cap could be constructed from hard plastic with a top diameter of 9 inches, a bottom diameter of 10½ inches, a height of 3½ inches or more, and there could be four slots 1 inch by 1½ inches high cut into the cap. All the elastic straps could be sewn together.

We claim:

1. A trash can conversion kit for use in converting a single bin trash container having an upper open end with an upper rim into a container capable of holding a plurality of trash bags comprising;

an elastically expandable circular ring device attached to the perimeter of said upper rim with at least one diametrical elastic strap extending over said upper open end which creates edges allowing attachment of said trash bags thereto.

* * * * *